US011075445B2

(12) United States Patent
Im et al.

(10) Patent No.: US 11,075,445 B2
(45) Date of Patent: Jul. 27, 2021

(54) COMMUNICATION DEVICE AND ELECTRONIC DEVICE

(71) Applicant: Samsung Electronics Co., Ltd., Gyeonggi-do (KR)

(72) Inventors: Hoyoung Im, Gyeonggi-do (KR); Seunggil Jeon, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 177 days.

(21) Appl. No.: 16/372,684

(22) Filed: Apr. 2, 2019

(65) Prior Publication Data

US 2019/0305405 A1 Oct. 3, 2019

(30) Foreign Application Priority Data

Apr. 3, 2018 (KR) ..... 10-2018-0038436

(51) Int. Cl.
*H01Q 1/24* (2006.01)
*H01Q 9/04* (2006.01)

(52) U.S. Cl.
CPC ..... *H01Q 1/243* (2013.01); *H01Q 9/0407* (2013.01)

(58) Field of Classification Search
CPC .... H01Q 9/0407; H01Q 9/0414; H01Q 1/243; H01Q 21/065; H01Q 13/18; H01Q 19/005
See application file for complete search history.

(56) References Cited

U.S. PATENT DOCUMENTS

| | | | | |
|---|---|---|---|---|
| 7,821,460 | B2 | 10/2010 | Schillmeier et al. | |
| 8,552,920 | B2 | 10/2013 | Chung et al. | |
| 8,646,698 | B2 | 2/2014 | Chen et al. | |
| 9,929,886 | B2 | 3/2018 | Amadjikpe et al. | |
| 10,269,005 | B2 | 4/2019 | Lee et al. | |
| 10,361,476 | B2 | 7/2019 | Ou | |
| 10,461,401 | B2 | 10/2019 | Ko et al. | |
| 2010/0090903 | A1* | 4/2010 | Byun | H01Q 13/18 343/700 MS |
| 2012/0050126 | A1 | 3/2012 | Chung et al. | |
| 2013/0206844 | A1 | 8/2013 | Chen et al. | |
| 2016/0210616 | A1 | 7/2016 | Lee et al. | |

(Continued)

FOREIGN PATENT DOCUMENTS

| | | | |
|---|---|---|---|
| EP | 3 457 493 | A1 | 3/2019 |
| KR | 10-2012-0021037 | A | 3/2012 |

(Continued)

OTHER PUBLICATIONS

International Search Report dated Jul. 29, 2019.
European Search Report dated Mar. 18, 2021.

*Primary Examiner* — Ricardo I Magallanes
(74) *Attorney, Agent, or Firm* — Cha & Reiter, LLC.

(57) ABSTRACT

An electronic device according to an embodiment disclosed in the disclosure includes a rear cover, a cover glass that faces the rear cover, and a communication device disposed between the rear cover and the cover glass. The communication device includes a printed circuit board including a first surface, a second surface and a side surface that surrounds a space between the first surface and the second surface, a communication circuit disposed in the printed circuit board or on the first surface, and at least one antenna unit disposed in the printed circuit board or on the second surface.

20 Claims, 9 Drawing Sheets

(56) References Cited

U.S. PATENT DOCUMENTS

| | | | | |
|---|---|---|---|---|
| 2016/0351996 | A1 | 12/2016 | Ou | |
| 2017/0069958 | A1* | 3/2017 | Ko | H01Q 1/243 |
| 2017/0353338 | A1 | 12/2017 | Amadjikpe et al. | |
| 2020/0373672 | A1* | 11/2020 | Paulotto | H01Q 9/0442 |

FOREIGN PATENT DOCUMENTS

| | | | |
|---|---|---|---|
| KR | 10-1222314 | B1 | 1/2013 |
| KR | 10-1556019 | B1 | 10/2015 |
| KR | 10-1700403 | B1 | 2/2017 |
| KR | 10-2017-0030196 | A | 3/2017 |
| KR | 10-2017-0040157 | A | 4/2017 |

* cited by examiner

COMMUNICATION DEVICE AND ELECTRONIC DEVICE

CROSS-REFERENCE TO RELATED APPLICATION(S)

This application is based on and claims priority under 35 U.S.C. § 119 to Korean Patent Application No. 10-2018-0038436, filed on Apr. 3, 2018, in the Korean Intellectual Property Office, the disclosure of which is incorporated by reference herein its entirety.

BACKGROUND

1. Field

Embodiments of the disclosure generally relate to the structure of a communication device and an electronic device including the same.

2. Description of Related Art

As mobile communication technology develops, electronic device equipped with antennas have become widespread. Such electronic devices transmit and receive various data or content (e.g., messages, pictures, videos, music files, games) through their antennas. When the electronic device (e.g. a communication device) is equipped with multiple antennas, it has an effective isotropic radiated power (EIRP) that is larger than that of a single antenna, allowing the communication device to transmit/receive data more efficiently.

The above information is presented as background information only to assist with an understanding of the disclosure. No determination has been made, and no assertion is made, as to whether any of the above might be applicable as prior art with regard to the disclosure.

SUMMARY

A communication device that has a plurality of antenna elements may accordingly include antenna structures that are more complicated and more difficult to manufacture than a single antenna element. In addition, when manufacturing the communication device, deviation may be caused between the plurality of antennas and various other components, which may degrade the performance of the communication device.

Aspects of the disclosure are to address at least the above-mentioned problems and/or disadvantages and to provide at least the advantages described below. Accordingly, an aspect of the disclosure is to provide a communication device and an electronic device including the communication device.

In accordance with an aspect of the disclosure, an electronic device includes a rear cover, a cover glass that faces the rear cover, and a communication device disposed between the rear cover and the cover glass, wherein the communication device includes a printed circuit board including a first surface and a second surface that faces the first surface, a communication circuit disposed in the printed circuit board or on the first surface, and at least one antenna unit disposed in the printed circuit board or on the second surface, wherein the at least one antenna unit includes a structure disposed on the second surface, forming an opening, and including a side surface that surrounds at least a portion of the opening and a top surface connected to the side surface to cover the opening, a patch type radiator that faces the top surface so that the opening is between the top surface and the patch type radiator, and a feeder that electrically connects the patch type radiator and the communication circuit, and wherein the communication circuit feeds power to the feeder and transmits and receives signals in a specified frequency band via an electrical path formed through the feeder and the patch type radiator.

In accordance with another aspect of the disclosure, a communication device includes a printed circuit board including a first surface and a second surface that faces the first surface, at least one antenna unit disposed in the printed circuit board or on the first surface, the at least one antenna unit including a patch type radiator disposed in the printed circuit board or on the first surface, a feeder that extends from the patch type radiator toward the second surface, and a structure disposed in the first surface, having an opening formed in an region corresponding to the patch type radiator, and including a side surface that surrounds at least a portion of the opening and a top surface that covers the opening, and a communication circuit disposed in the printed circuit board or on the second surface, wherein the communication circuit feeds power to the feeder, and transceives a signal in a specified frequency band via an electrical path formed through the feeder and the patch type radiator.

In accordance with another aspect of the disclosure, an electronic device includes a housing, an antenna structure disposed in the housing, the antenna structure including a printed circuit board (PCB) that includes at least one insulating layer and at least one ground layer, an array of conductive plates that includes a first conductive plate formed in or on the printed circuit board, and an array of conductive structural objects disposed on the first surface of the printed circuit board. The array of conductive structural objects includes a first conductive structural object, the first conductive structural object including a top plate that at least partially overlaps the first conductive plate in a top view of the printed circuit board, at least one sidewall that partially surrounds a space between the top plate and the first conductive plate and bent from the top plate toward the printed circuit board, and at least one connecting portion bent from the at least one sidewall and electrically connected to the ground layer via solder. The electronic device further includes a wireless communication circuit electrically connected to the array of conductive plates to transmit and/or receive a signal having a frequency of 3 GHz to 100 GHz.

Other aspects, advantages, and salient features of the disclosure will become apparent to those skilled in the art from the following detailed description, which, taken in conjunction with the annexed drawings, discloses certain embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
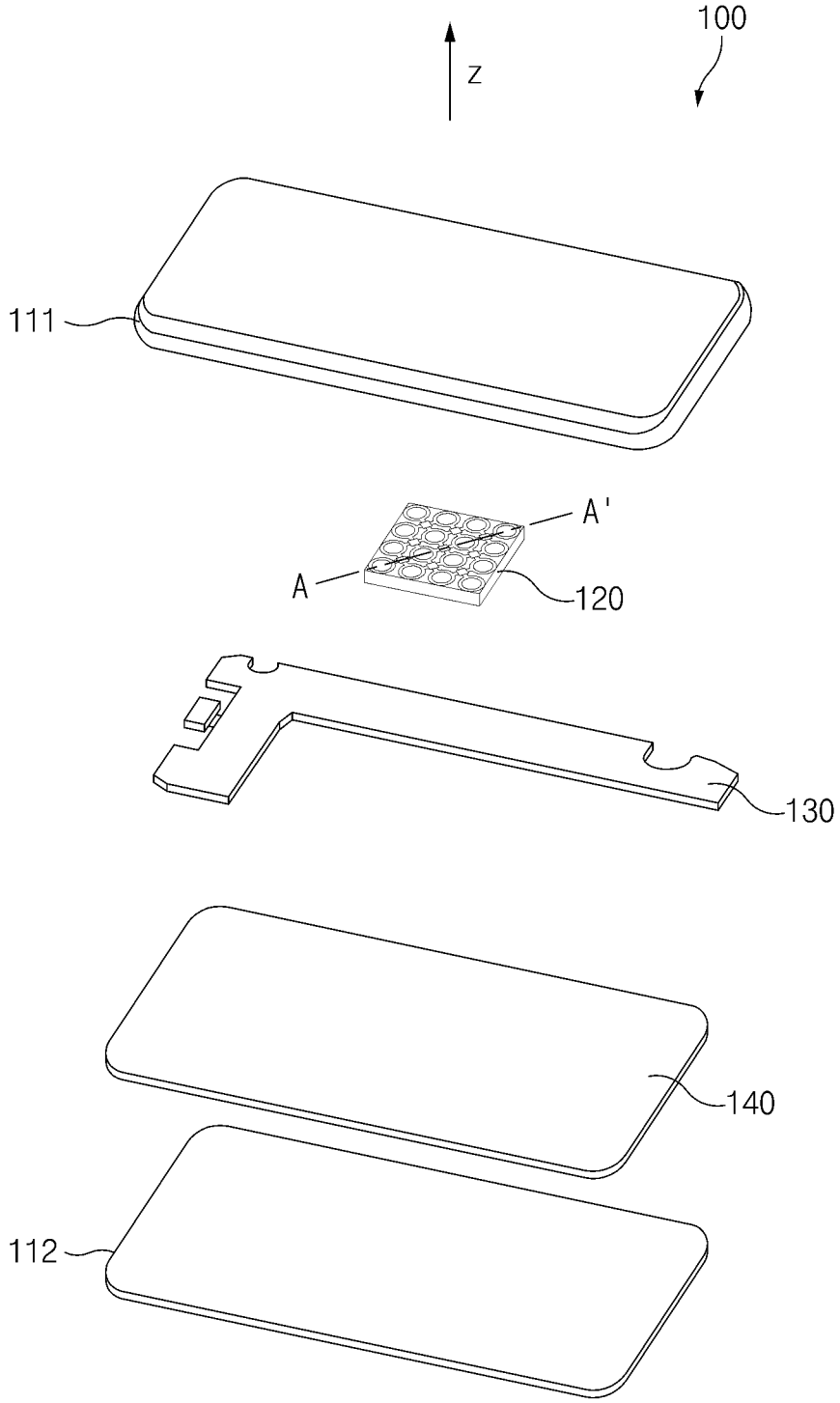
FIG. 1 illustrates an exploded perspective view of an electronic device according to an embodiment.

FIG. 1 illustrates an exploded perspective view of an electronic device according to an embodiment.

Referring to FIG. 1, an electronic device 100 may include a rear cover 111, a cover glass 112, a communication device 120, a printed circuit board 130, and a display 140.

The rear cover 111 may constitute the exterior of the electronic device 100. The rear cover 111 may be made of tempered glass, plastic, and/or metal to protect various components mounted inside the electronic device 100 (e.g., the display 140 and the printed circuit board 130) from external impact. According to an embodiment, the rear cover 111 may be formed integrally with the cover glass 112 or may be attachable to or removable from the cover glass 112 by a user.

The cover glass 112 may be substantially transparent so that light generated by the display 140 may pass through the cover glass 112. In addition, the user may perform touch operations by contacting the cover glass with a part of the user's body (e.g., a finger) or with a part of an object (e.g. an electronic pen). The cover glass 11 may be made of, for example, tempered glass, reinforced plastic, or flexible polymeric material. According to an embodiment, the cover glass 112 may be also referred to as a glass window.

The communication device 120 may communicate with an external device. For example, the communication device 120 may transmit data to a smart phone of another user or receive data from the smart phone of the other user.

According to an embodiment, the communication device 120 may transmit and receive signals in various specified frequency bands. For example, the communication device 120 may transmit and receive signals in the frequency band of 3 GHz to 100 GHz. In another example, the communication device 120 may transmit and receive signals in specified directions. For example, the communication device 120 may transmit and receive signals in the direction of the rear cover 111 (e.g., the +z direction shown in FIG. 1). In one embodiment, the communication device 120 may be attached to the rear cover 111.

According to an embodiment of the disclosure, the communication device 120 may have a simplified structure as illustrated in FIG. 1, which allows the manufacturing thereof to be simplified.

The printed circuit board 130 may be mounted with various electronic components, elements or integrated circuits of the electronic device 100. For example, the printed circuit board 130 may be mounted with an application processor (AP), a communication processor (CP), and/or memory. In the disclosure, the printed circuit board 130 may be referred to as a main board or a printed board assembly (PBA).

According to an embodiment, the display 140 may be disposed between the cover glass 112 and the printed circuit board 130. The display 140 may be electrically connected to the printed circuit board 130 to output content (e.g., text, images, video, icons, widgets, or symbols) and receive touch inputs (e.g., touch, gesture, or hovering inputs).

In this disclosure, the description given in reference to FIG. 1 may be applied to the configurations in the other drawings having the same reference numerals as in FIG. 1.

Figure 2:
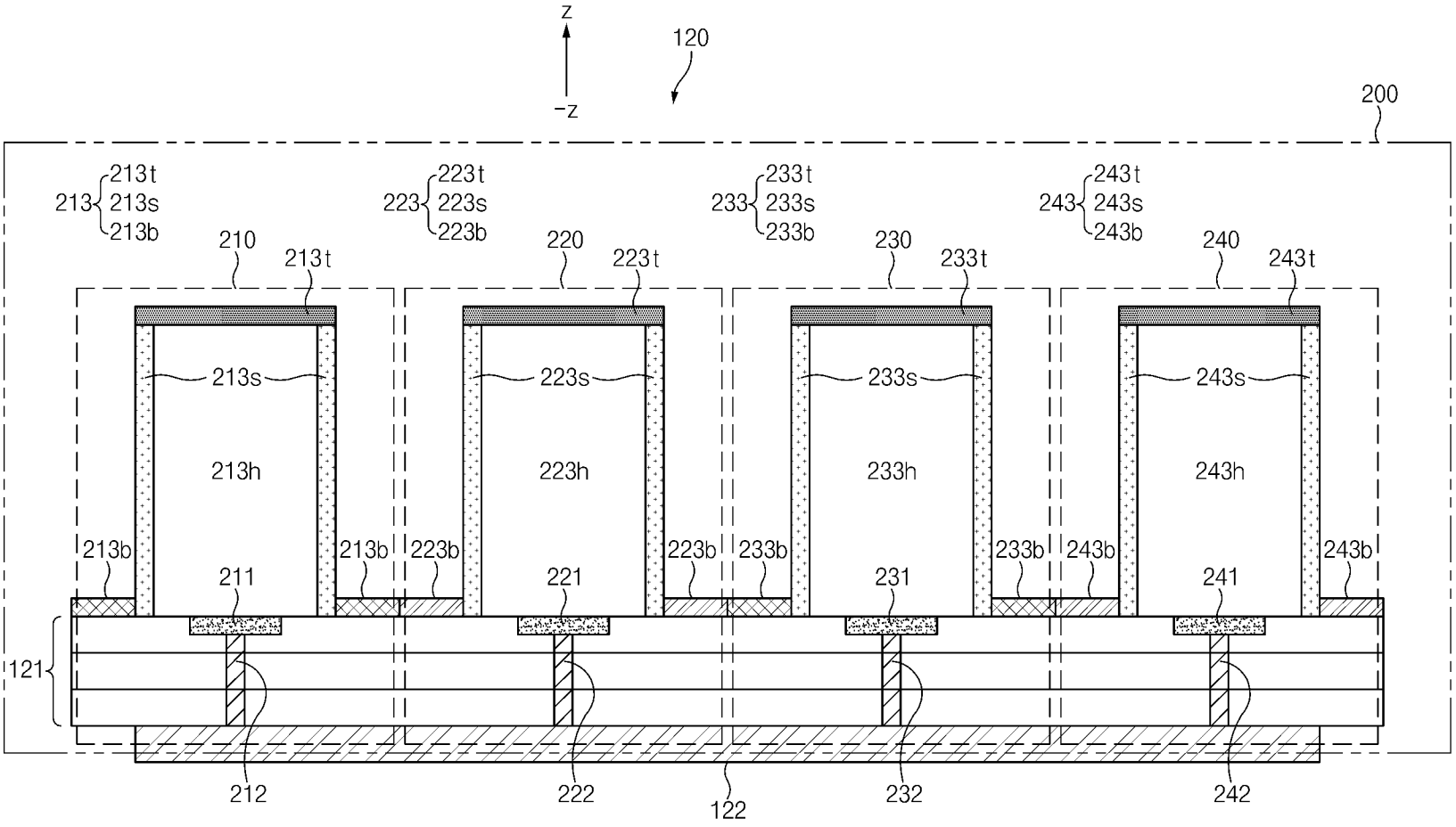
FIG. 2 illustrates a cross-sectional view of a communication device according to an embodiment.

FIG. 2 illustrates a cross-sectional view of a communication device according to an embodiment. FIG. 2 illustrates a cross-sectional view taken along line A-A' with respect to the communication device 120 of FIG. 1.

Referring to FIG. 2, the communication device 120 may include a printed circuit board 121, a communication circuit 122, and a first antenna unit 210, a second antenna unit 220, a third antenna unit 230, and/or a fourth antenna unit 240.

According to an embodiment, the printed circuit board 121 may be mounted with the communication circuit 122, the first antenna unit 210, the second antenna unit 220, the third antenna unit 230, and/or the fourth antenna unit 240. For example, the communication circuit 122 may be disposed in one surface of the printed circuit board 121 (e.g., the lower surface). In this case, the first antenna unit 210, the second antenna unit 220, the third antenna unit 230, and/or the fourth antenna unit 240 may be disposed in the other surface of the printed circuit board 121 (e.g., the upper surface) or in the printed circuit board 121.

According to an embodiment, the printed circuit board 121 may include a plurality of layers. At least one of the plurality of layers may include a dielectric and/or a conductor.

According to an embodiment, the communication circuit 122 may feed power to the first antenna unit 210, the second antenna unit 220, the third antenna unit 230, and/or the fourth antenna unit 240. In the disclosure, "feeding power" may mean the operation of applying, by the communication circuit 122, a current to at least one of the first antenna unit 210 to the fourth antenna unit 240.

According to an embodiment, the communication circuit 122 may transmit and receive signals in specified frequency bands based on electronic paths formed through the first antenna unit 210 to the fourth antenna unit 240. The communication circuit 122 may transmit and receive signals in the frequency band of about 28 GHz based on an electronic path formed through the first antenna unit 210. For example, the signal may be radiated in the +z direction. In the disclosure, the communication circuit may be referred to as a wireless communication circuit.

According to an embodiment, the first antenna unit 210 may include a first patch type radiator 211, a first feeder 212, and a first conductive structure 213. The second antenna unit 220 may include a second patch type radiator 221, a second feeder 222, and a second conductive structure 223. The third antenna unit 230 may include a third patch type radiator 231, a third feeder 232, and a third conductive structure 233. The fourth antenna unit 240 may include a fourth patch type radiator 241, a fourth feeder 242, and a fourth conductive structure 243. The antenna units 210, 220, 230, and 240 may have substantially the same configuration and structure, as illustrated in FIG. 2, or may have different shapes, sizes, or configurations. Hereinafter, as an example, the first antenna unit 210 will be described.

According to an embodiment, the first patch type radiator 211 to the fourth patch type radiator 241 may be disposed on a surface of the printed circuit board 121 or, as illustrated in FIG. 2, may be disposed beneath the surface of the printed circuit board 121. According to an embodiment, the first patch type radiator 211 is disposed in the printed circuit board 121 (e.g., on one of the plurality of the layers of the printed circuit board 121). In the disclosure, the first patch type radiator 211 to the fourth patch type radiator 241 may be referred to as an array of conductive plates.

The first feeder 212 to the fourth feeder 242 may electrically connect the first patch type radiator 211 to the fourth patch type radiator 241 and the communication circuit 122. For example, when the first patch type radiator 211 is disposed beneath the surface of the printed circuit board 121 as illustrated in FIG. 2, the first feeder 212 may extend from the communication circuit 122 to the first patch type radiator 211 by passing through the plurality of the layers of the printed circuit board 121.

According to an embodiment, the communication circuit 122 may feed power to the first to fourth feeders 212 to 242 so that current may be fed to the first patch type radiator 211 to the fourth patch type radiator 241. For example, the communication circuit 122 may transmit and receive signals in a specified frequency band based on the electrical path formed through the first feeder 212 and the first patch type radiator 211.

According to an embodiment, the first conductive structure 213 may include a first bottom surface or connecting portion 213*b*, a first side surface or first sidewall and second sidewall 213*s*, and a first top surface or top plate 213*t*. According to an embodiment, the second conductive structure 223, the third conductive structure 233, and/or the fourth conductive structure 243 may be similar or identical in structure to the first conductive structure 213. In the disclosure, the first conductive structure 213 to the fourth conductive structure 243 may be referred to as an array of conductive structural objects.

The first bottom surface 213*b* may be attached to the printed circuit board 121 using an adhesive such that the first conductive structure 213 is disposed on the printed circuit board 121, for example. The first side surface 213*s* may extend from the first bottom surface 213*b* to the first top surface 213*t* (e.g., the +z direction), for example. At least a portion of the first side surface 213*s* may surround a first empty space or opening 213*h* formed in the first conductive structure 213. The first top surface 213*t* may extend from the side surface 213*s* in a direction parallel to the printed circuit board 121, for example. The first top surface 213*t* may face the first patch type radiator 211 with the first empty space 213*h* in between the two.

According to an embodiment, the first top surface 213*t* may at least partially overlap the first patch type radiator 211 in a top view of the printed circuit board 121. The first side surface 213*s* may at least partially surround the space 213*h* between the first top surface 213*t* and the first patch type radiator 211 and may extend toward the printed circuit board 121 from the first top surface 213*t*. The first bottom surface 213*b* may extend from the first side surface 213*s* in a direction parallel to the surface of the printed circuit board 121 and be electrically connected to a ground layer in the printed circuit board 121 via, for example, solder.

According to an embodiment, the first side surface 213*s* may prevent the first antenna unit 210 from affecting another antenna unit (e.g., the second antenna unit 220), when the first antenna unit 210 transmits or receives a signal. Likewise, the first side surface 213*s* may prevent another antenna unit from affecting the first antenna unit 210 when the other antenna unit (for example, the second antenna unit 220) transmits or receives a signal.

According to an embodiment, the first top surface 213*t* may direct signals transmitted or received by the first antenna unit 210 in a specific direction. For example, the first top surface 213*t* may direct signals to be transmitted in the +z direction and direct signals to be received in the −z direction. Thus, the first top surface 213*t* directionally channels the signals transceived by the first antenna unit 210, thereby strengthening the transceived signals.

According to an embodiment, the first bottom surface 213*b*, the first side surface 213*s*, and the first top surface 213*t* may be made of different materials. For example, the first bottom surface 213*b* may be made of a non-conductive material, and the first side surface 213*s* and the first top surface 213*t* may be made of a conductor (e.g., metal). In another embodiment, the entire first conductive structure 213 including the first bottom surface 213*b* may be made of conductive materials.

According to an embodiment, the antenna structure 200 may include an antenna unit (e.g., the first antenna unit 210, the second antenna unit 220, the third antenna unit 230, or the fourth antenna unit 240) and the printed circuit board 121.

According to an embodiment of the disclosure, the communication device 120 may have a relatively simple structure in which the first conductive structure 213 to the fourth conductive structure 243 are mounted on the printed circuit board 121, thereby simplifying the manufacturing thereof and reducing the potential deviation between the components. Since it is possible to produce the communication device 120 by attaching the first conductive structure 213 to the fourth conductive structure 243 onto the printed circuit board 121, the process of manufacturing the communication device 120 may be simplified.

The communication device 120 illustrated in FIG. 2 is merely one embodiment, and the disclosure herein are not limited to those illustrated in FIG. 2. For example, the communication device 120 may further include other components beyond the printed circuit board 121, the communication circuit 122, and the antenna units 210, 220, 230, and 240, or may not include some of the components shown in FIG. 2. In another example, the shapes and connection relationships of the printed circuit board 121, the communication circuit 122, and the antenna units 210, 220, 230, and 240 may differ from those illustrated in FIG. 2.

Figure 3:
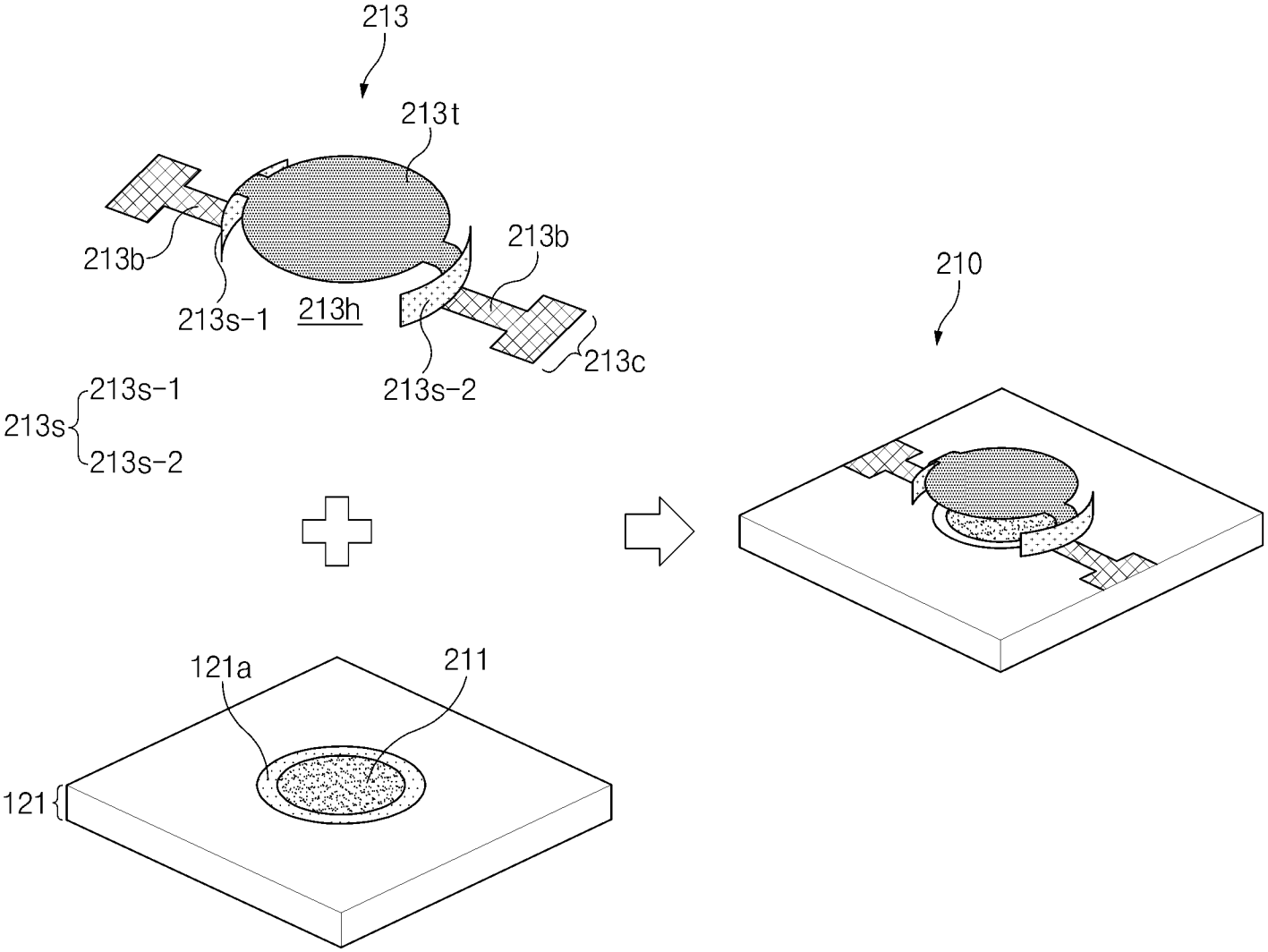
FIG. 3 illustrates an exploded perspective view of a first antenna unit according to an embodiment.

FIG. 3 illustrates an exploded perspective view of the first antenna unit according to an embodiment.

Referring to FIG. 3, the printed circuit board 121 may include a first pad 121*a*. The first pad 121*a* may have substantially the same shape as the first patch type radiator 211 such that the first patch type radiator 211 is easily mounted on a surface of the printed circuit board 121. In another example, the first pad 121*a* may include a dielectric to reduce noise introduced into the first patch type radiator 211. In the disclosure, the first pad 121*a* may be referred to as a "surface mount device (SMD) pad."

According to an embodiment, at least a portion of the first bottom surface 213*b* of the first conductive structure 213 may have a wide panel shape so as to be easily attached to the printed circuit board 121. For example, the width of the portion connected to the first side surface 213*s* may be relatively narrow, but the width of the portion may increase progressively as the first bottom surface 213*b* extends away from the first side surface 213*s*. Since the first bottom surface 213*b* has the wide panel shape, the first bottom surface 213*b* may stably support the first conductive structure 213.

According to an embodiment, a first connecting portion 213*c* of the first bottom surface 213*b*, which is relatively wide, may be connected to the second conductive structure 223. Thus, the first conductive structure 213 may be connected to the second conductive structure 223 included in the second antenna unit 220 through the first connecting portion 213*c*. Although not illustrated in FIG. 3, the structures 213, 223, 233, and 243 included in each antenna unit may be connected to one another through the connecting portions.

According to an embodiment, at least a portion of the first side surface 213*s* may surround at least a portion of the first empty space 213*h*. For example, as illustrated in FIG. 3, a first portion 213*s*-1 of the first side surface 213*s* and a second portion 213*s*-2 of the first side surface 213*s* may not be connected to each other. In another embodiment, the first portion 213*s*-1 of the first side surface 213*s* and the second portion 213*s*-2 of the first side surface 213*s* may be connected to each other such that the first side surface 213*s* and the second portion 213*s*-2 form a cylinder.

According to an embodiment, the diameter of the cylinder defined by the first portion 213*s*-1 of the first side surface 213*s* and the second portion 213*s*-2 of the first side surface 213*s* may be greater than the diameter of the first pad 121*a*. Accordingly, when the first conductive structure 213 is attached to the printed circuit board 121, the first pad 121*a* and the first patch type radiator 211 may be positioned in the first empty space 213*h*.

According to an embodiment, the first top surface 213*t* may extend from the first portion 213*s*-1 of the first side surface 213*s* and the second portion 213*s*-2 of the first side surface 213*s*. The diameter of the first top surface 213*t* may be substantially the same as the diameter of the first patch type radiator 211, for example. The first top surface 213*t* may be spaced apart from the first patch type radiator 211 substantially by the height of the first side surface 213*s*.

The first antenna unit 210 illustrated in FIG. 3 is merely one embodiment, and embodiments of the disclosure are not limited to those illustrated in FIG. 3. For example, the first antenna unit 210 may further include other components in addition to the first patch type radiator 211, the first feeder 212, and the first conductive structure 213, or may not include some of the shown components. The shapes and connection relationships of the first patch type radiator 211, the first feeder 212, and the first conductive structure 213 may differ from those illustrated in FIG. 3. In the disclosure, the description related with the first antenna unit 210 may be equally applied to the second antenna unit 220 to the fourth antenna unit 240.

According to an embodiment, the first side surface 213*s* may include the first portion 213*s*-1 and the second portion 213*s*-2 disposed on opposite sides to each other with respect to the first top surface 213*t* at the center, in the top view of the printed circuit board 121. The first portion 213*s*-1 and the second portion 213*s*-2 may be separated from each other and, in the disclosure, the first portion 213*s*-1 and the second portion 213*s*-2 may be referred to as first sidewall and second sidewall. According to an embodiment, the connecting portion 213*b* may include a first connecting portion and a second connecting portion disposed on the opposite sides of the first conductive structure 213 with the first top surface 213*t* at the center, in the top view of the printed circuit board 121.

Figure 4:
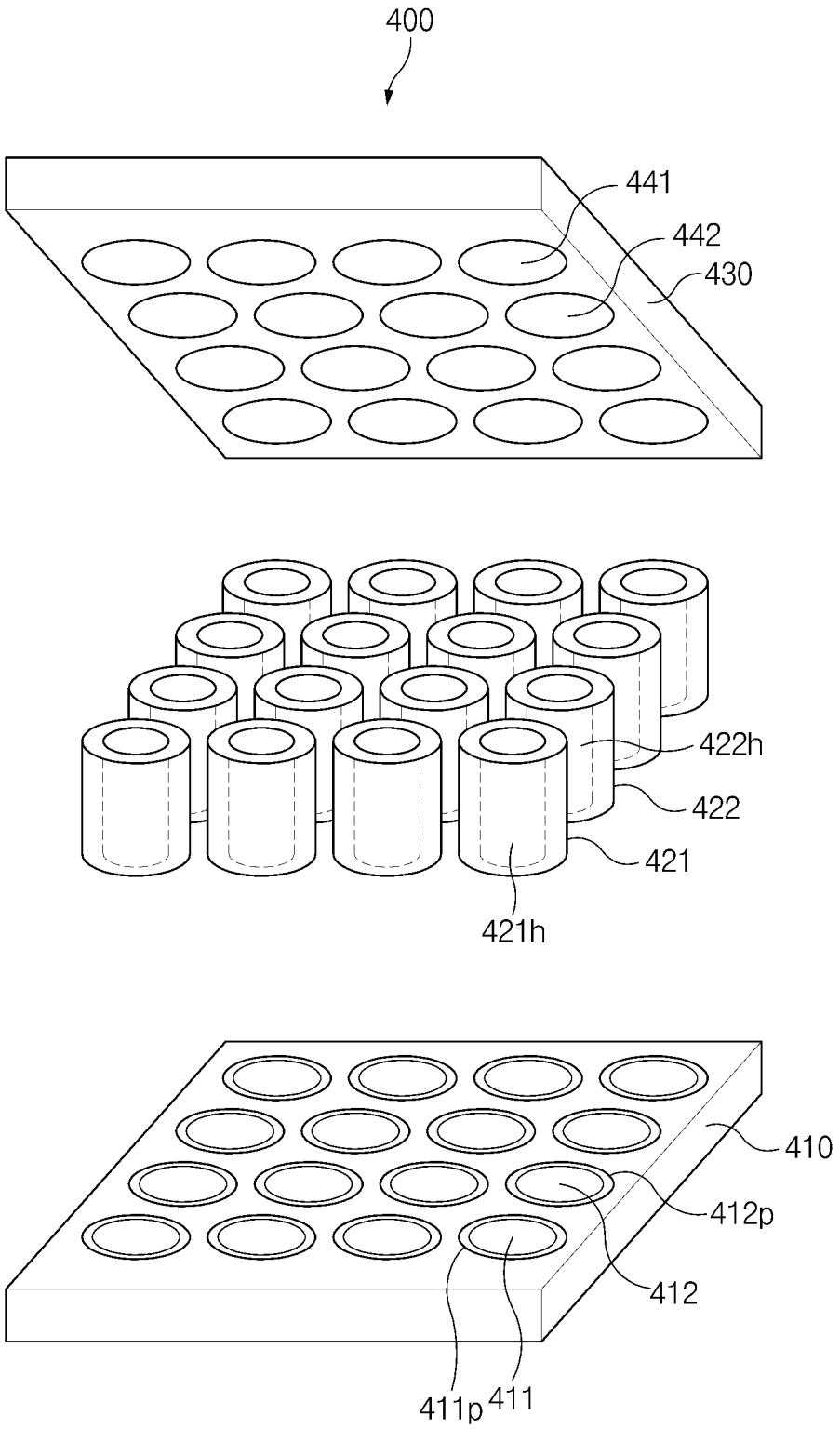
FIG. 4 illustrates a communication device according to another embodiment.

FIG. 4 illustrates an antenna structure according to another embodiment.

Referring to FIG. 4, an antenna structure 400 (e.g., the antenna structure 200 of FIG. 2) may include a first printed circuit board 410 (e.g., the printed circuit board 121 of FIG. 2), a first cylinder type structure 421, a second cylinder type structure 422, a first patch type radiator 411 (e.g., the first patch type radiator 211 of FIG. 2), a second patch type radiator 412 (e.g., the second patch type radiator 221 of FIG. 2), a first pad 411*p*, a second pad 412*p*, and a second printed circuit board 430. The description related with the printed circuit board 121 illustrated in FIG. 2 may be also applied to the first printed circuit board 410. In FIG. 4, descriptions related to the same or similar components described above may be omitted.

According to an embodiment, the first cylinder type structure 421 may be mounted on the first patch type radiator 411. The second cylinder type structure 422 may be mounted on the second patch type radiator 412. Empty space 421*h* and 422*h* may be formed in the first cylinder type structure 421 and the second cylinder type structure 422. In other words, the first cylinder type structure 421 and the second cylinder type structure 422 may surround the empty space 421*h* and 422*h*.

According to an embodiment, the first cylinder type structure 421 and/or the second cylinder type structure 422 may maintain separation between the first printed circuit board 410 and the second printed circuit board 430. For example, as the height of the first cylinder type structure 421 or the second cylinder type structure 422 increases, the spacing between the first printed circuit board 410 and the second printed circuit board 430 may also increase.

According to an embodiment, the first cylinder type structure 421 may reduce the influence of other surrounding radiators on the first patch type radiator 411 when the first patch type radiator 411 is radiating a signal. For example, when the first patch type radiator 411 radiates a signal, the first cylinder type structure 421 may reduce the influence (e.g. noise) of the second patch type radiator 412 on the first patch type radiator 411.

According to an embodiment, a first director 441 and/or a second director 442 may be disposed on the second printed circuit board 430. For example, the first director 441 may be disposed in a region corresponding to the first patch type radiator 411. The second director 442 may be disposed in a region corresponding to the second patch type radiator 412. Accordingly, the first patch type radiator 411 may face the first director 441 with the empty space 421*h* in between. The second patch type radiator 412 may face the second director 442 with the empty space 422*h* in between.

According to an embodiment, the first director 441 may direct a signal radiated from the first patch type radiator 411 so that the signal is output in a specific direction. Similarly, the first director 441 may direct a signal incoming to the first patch type radiator 411 from outside of the antenna structure 400 toward the first patch type radiator 411. The second director 442 may direct a signal radiated from the second patch type radiator 412 so that the signal is output in a specific direction. Similarly, the second director 442 may direct a signal incoming to the second patch type radiator 412 from outside of the antenna structure 400 toward the second patch type radiator 412. In the disclosure, a director may also be referred to as an inductor.

According to an embodiment, the first director 441 or the second director 442 may be formed on a surface of the second printed circuit board 430 by a laser direct structuring (LDS) process. In another embodiment, the first director 441 or the second director 442 may be implemented on the second printed circuit board 430 during a manufacturing process for the second printed circuit board 430.

According to an embodiment, the antenna structure 400 may not include the second printed circuit board 430, which would be different than the embodiment shown in FIG. 4. For example, the first director 441 may be instead disposed on the first cylinder type structure 421. The second director 442 may be disposed on the second cylinder type structure 422. For example, the first director 441 may be disposed on a top surface of the empty space 421*h* (e.g., the surface of the empty space 421*h* opposite the surface contacting the first patch type radiator 411). Accordingly, the first patch type radiator 411 and the first director 441 may face each other with the empty space 421*h* in between. The first director 441 may be same as the first top surface 213*t* described in connection with FIG. 2.

According to an embodiment, the antenna structure 400 may include the first pad 411*p* and/or the second pad 412*p*. The first pad 411*p* may have substantially the same shape as the first patch type radiator 411 such that the first patch type radiator 411 is easily mounted on a surface of the first printed circuit board 410. In another example, the first pad 411*p* may include a dielectric to reduce noise introduced into the first patch type radiator 411. The description related with the first pad 411*p* may also be applied to the second pad 412*p*.

The antenna structure 400 illustrated in FIG. 4 is merely one embodiment, and embodiments of the disclosure are not limited to those illustrated in FIG. 4. For example, the antenna structure 400 may include other components in addition to the first printed circuit board 410, the first cylinder type structure 421, the second cylinder type structure 422, the first patch type radiator 411, the second patch type radiator 412, the first pad 411*p*, the second pad 412*p*, and the second printed circuit board 430. Alternatively, the antenna structure 400 may not include some of the listed components. In another example, the shapes and connection relationships of the first printed circuit board 410, the second cylinder type structure 422, the first patch type radiator 411, the second patch type radiator 412, the first pad 411*p*, the second pad 412*p*, and the second printed circuit board 430 may differ from those illustrated in FIG. 4.

Figure 5A:
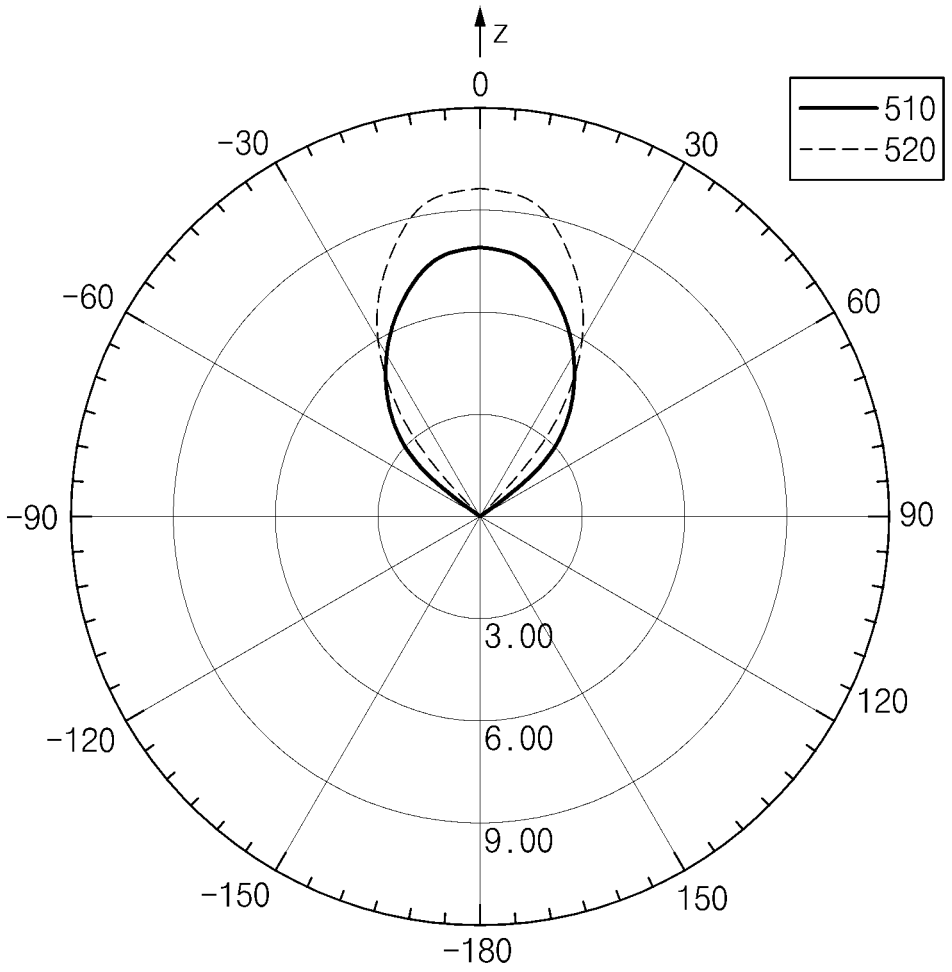
FIG. 5A illustrates a beam pattern according to an embodiment.
Figure 5B:
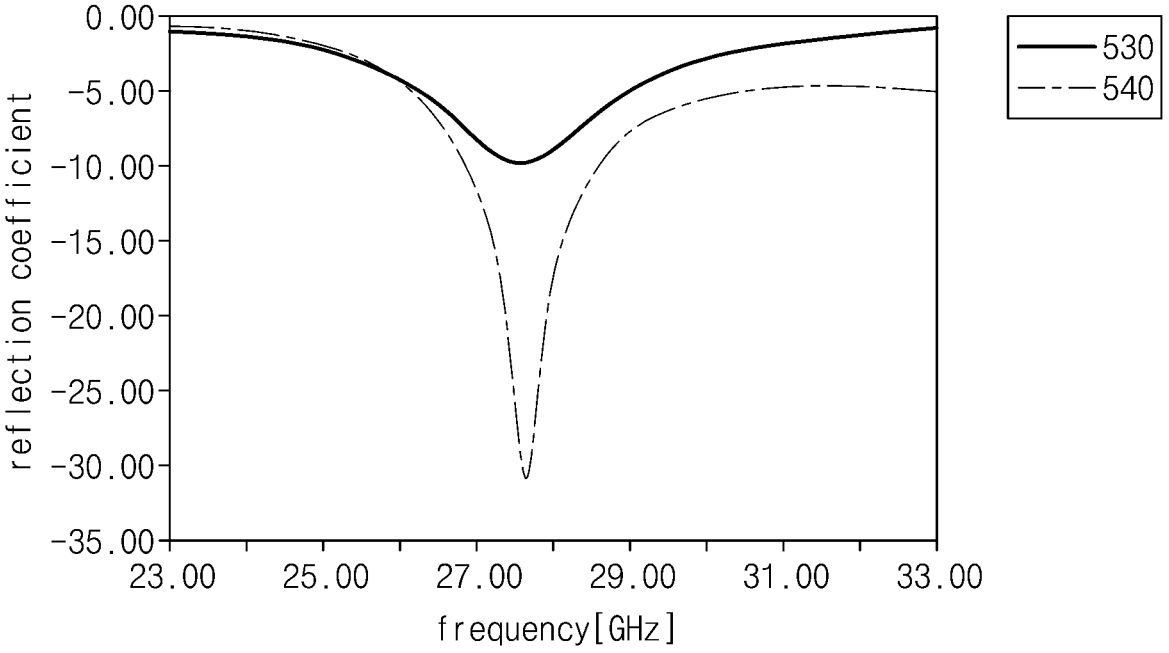
FIG. 5B illustrates a reflection coefficient according to an embodiment.

FIG. 5A illustrates a beam pattern according to an embodiment. In this disclosure, the beam pattern may indicate the field strength and the direction of a signal transmitted and received by the communication device. FIG. 5B illustrates a reflection coefficient according to an embodiment.

Referring to FIG. 5A, a graph 510 shows a beam pattern of an exemplary conventional communication device. The conventional communication device may refer to a communication device that does not include the first conductive structure 213. A graph 520 shows a beam pattern of the communication device 120 according to an embodiment of the disclosure.

Referring to the graph 510 and the graph 520, the conventional communication device may transmit and receive signals with an intensity of about 8 dB in the +z direction. However, the communication device 120 according to an embodiment of the disclosure may transmit and receive signals with an intensity of about 10 dB in the +z direction. For example, since the first conductive structure 213 is mounted in the communication device 120, the communication device 120 may transmit and receive signals with stronger intensity. Accordingly, the signal transmission/reception rate of the communication device 120 may be improved.

Referring to FIG. 5B, a graph 530 shows a reflection coefficient of the conventional communication device. A graph 540 shows the reflection coefficient of the communication device 120 according to an embodiment of the disclosure.

Referring to the graph 530 and the graph 540, the conventional communication device may have a reflection coefficient of about −10 dB in a frequency band of about 28 GHz. However, the communication device 120 according to an embodiment of the disclosure may have a reflection coefficient of about −30 dB in the frequency band of 28 GHz. For example, since the first conductive structure 213 is mounted in the communication device 120, the amount of reflection caused by impedance difference may be reduced. Accordingly, the signal transmission/reception rate of the communication device 120 may be improved.

The electronic device 100 according to an embodiment of the disclosure may include the rear cover 111, the cover glass 112 facing the rear cover 111, and the communication device 120 disposed between the rear cover 111 and the cover glass 112, wherein the communication device 120 may include the printed circuit board 121 including a first surface and a second surface facing the first surface, a communication circuit 122 disposed in the printed circuit board 121 or on the first surface, and at least one antenna unit disposed in the printed circuit board 121 (e.g., the first antenna unit 210 of FIG. 2) or on the second surface, wherein the at least one antenna unit (e.g., 210) may include a structure (e.g., 213) disposed on the second surface and forming an opening (for example, 213*h*), the structure 213 including a side surface (e.g., 213*s*) surrounding at least a portion of the opening 213*h* and a top surface (e.g., 213*t*) connected to the side surface 213*s* to cover the opening 213*h*, a patch type radiator (e.g., 211) facing the top surface 213*t* so that the opening (e.g., 213*h*) is between the top surface 213*t* and the patch type radiator 211, and a feeder (e.g., 212) that electrically connects the patch type radiator 211 and the communication circuit 122, and wherein the communication circuit 122 may feed power to the feeder 212 and transmit and receive a signal in a specified frequency band via an electrical path formed through the feeder 212 and the patch type radiator 211.

The side surface 213*s* of the structure 213 according to an embodiment of the disclosure may include the first curved surface 213*s*-1 that surrounds at least a portion of the opening 213*h* and the second curved surface 213*s*-2 disposed opposite the first curved surface 213*s*-1 with respect to the opening 213*h* at the center.

A distance between the first curved surface 213*s*-1 and the second curved surface 213*s*-2 according to an embodiment of the disclosure may be greater than a diameter of the patch type radiator 211.

The side surface 213*s* of the structure 213 according to an embodiment of the disclosure may have a cylindrical shape.

The structure 213 according to an embodiment of the disclosure may further have a bottom surface (e.g., 213*b*) configured to extend from the side surface 213*s* of the structure 213 in a direction parallel to the second surface.

The bottom surface 213*b* according to an embodiment of the present invention may be attached to the second surface with an adhesive material.

The top surface 213*t* and the patch type radiator 211 according to an embodiment of the disclosure may be separated by a specified distance.

The patch type radiator 211 according to an embodiment of the disclosure may be disposed in the printed circuit board 121 or on the second surface.

The printed circuit board 121 according to an embodiment of the disclosure may include a plurality of layers, and at least one of the plurality of layers may include a dielectric.

The electronic device 100 according to an embodiment of the disclosure may further include the pad 121*a* disposed in the printed circuit board 121 or on the second surface, and the patch type radiator 211 may be disposed on the pad 121*a*.

The communication device 120 according to an embodiment of the disclosure may be attached to the rear cover 111.

The communication circuit 122 according to an embodiment of the disclosure may transmit a signal from the patch type radiator 211 toward the top surface 213*t*.

The electronic device 100 according to an embodiment of the disclosure may further include the display 140 disposed between the communication device 120 and the cover glass 112, and an additional printed circuit board 130.

The communication device 120 according to an embodiment of the disclosure may include the printed circuit board 121 including a first surface and a second surface facing the first surface, at least one antenna unit (e.g., 210) disposed in the printed circuit board 121 or on the first surface, the at least one antenna unit 210 including the patch type radiator 211 disposed in the printed circuit board 121 or on the first surface, the feeder 212 extending from the patch type radiator 211 toward the second surface, and the structure 213 disposed in the first surface, having the opening 213*h* formed in an region corresponding to the patch type radiator 211 and including the side surface 213*s* surrounding at least a portion of the opening 213*h* and the top surface 213*t* covering the opening 213*h*, and the communication circuit 122 disposed in the printed circuit board 121 or on the second surface, wherein the communication circuit 122 may feed power to the feeder 212, and transmit and receive a signal in a specified frequency band via an electrical path formed through the feeder 212 and the patch type radiator 211.

The side surface 213*s* of the structure 213 according to an embodiment of the disclosure may include the first curved surface 213*s*-1 configured to surround a portion of the opening 213*h* and the second curved surface 213*s*-2 disposed opposite the first curved surface 213*s*-1 with respect to the opening 213*h* at the center.

A distance between the first curved surface 213*s*-1 and the second curved surface 213*s*-2 according to an embodiment of the disclosure may be greater than the diameter of the patch type radiator 211.

The side surface 213*s* of the structure 213 according to an embodiment of the disclosure may have a cylindrical shape.

The structure 213 according to an embodiment of the disclosure may further include a bottom surface configured to extend from the side surface 213*s* of the structure 213 in a direction parallel to the first surface.

The bottom surface according to an embodiment of the disclosure may be attached to the first surface with an adhesive material.

The top surface 213*t* and the patch type radiator 211 according to an embodiment of the disclosure may be separated by a specified distance.

The electronic device 100 according to an embodiment of the disclosure may include a housing 111 and 112, an antenna structure 200 disposed in the housing 111 and 112, the antenna structure 200 may include the printed circuit board (PCB) 121 that includes at least one insulating layer and at least one ground layer, the array of conductive plates 211, 221, 231 and 241 that includes the first conductive plate 211 formed in or on the printed circuit board 121, and the array of conductive structural objects 213, 223, 233 and 243 disposed on the first surface of the printed circuit board 121. The array of conductive structural objects 213, 223, 233 and 243 may include the first conductive structural object 213, the first conductive structural object 213 including a top plate that at least partially overlaps the first conductive plate 211 in a top view of the printed circuit board 121, at least one sidewall 213*s* that partially surrounds the space 213*h* between the top plate 213*t* and the first conductive plate 211 and bent from the top plate 213*t* toward the printed circuit board 121, and at least one connecting portion 213*b* bent from the at least one sidewall 213*s* and electrically connected to the ground layer via solder. The electronic device 100 may further include a wireless communication circuit 122 electrically connected to the array of conductive plates 211, 221, 231 and 241 to transmit and/or receive a signal having a frequency of 3 GHz to 100 GHz.

The at least one connecting portion 213*b* according to an embodiment of the disclosure may not overlap the top plate 213*t* in the top view of the printed circuit board 121.

The at least one sidewall 213*s* according to an embodiment of the disclosure may include the first sidewall 213*s*-1 and the second sidewall 213*s*-2 disposed on opposite sides with respect to the top plate 213*t* at the center, in the top view of the printed circuit board 121.

The first sidewall 213*s*-1 and the second sidewall 213*s*-2 according to an embodiment of the disclosure may be separated from each other.

The at least one connecting portion 213*b* according to an embodiment of the disclosure may include a first connecting portion and a second connecting portion disposed on opposite sides with respect to the top plate 213*t* at the center, in the top view of the printed circuit board 121.

At least a portion of the wireless communication circuit 122 according to an embodiment of the disclosure may be disposed on a second surface of the printed circuit board 121 opposite the first surface.

Figure 6:
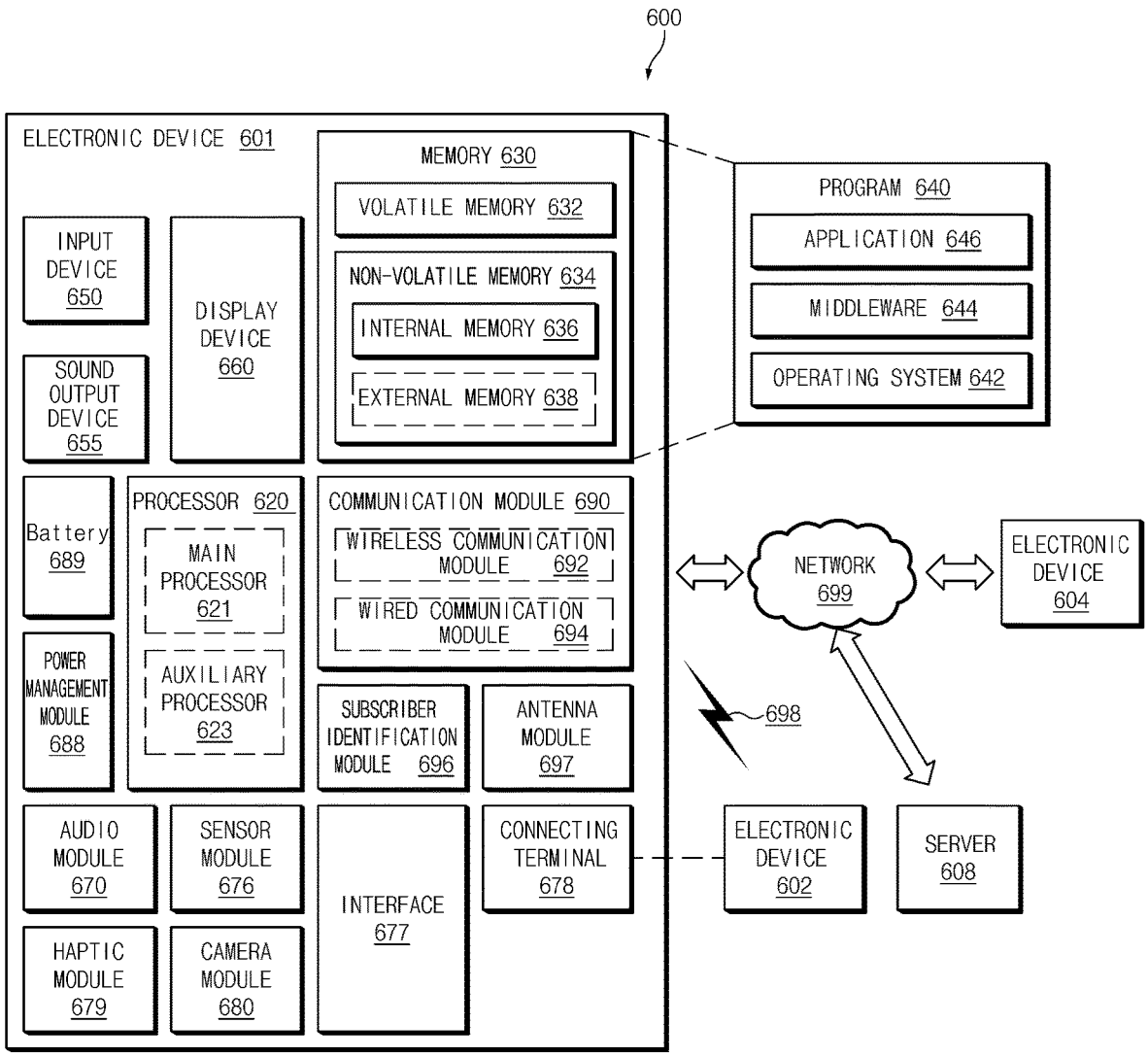
FIG. 6 is a block diagram of an electronic device in a network environment according to various embodiments.

FIG. 6 is a block diagram of an electronic device in a network environment according to various embodiments.

Referring to FIG. 6, an electronic device 601 may communicate with an electronic device 602 through a first network 698 (e.g., a short-range wireless communication) or may communicate with an electronic device 604 or a server 608 through a second network 699 (e.g., a long-distance wireless communication) in a network environment 600. According to an embodiment, the electronic device 601 may communicate with the electronic device 604 through the server 608. According to an embodiment, the electronic device 601 may include a processor 620, a memory 630, an input device 650, a sound output device 655, a display device 660, an audio module 670, a sensor module 676, an interface 677, a haptic module 679, a camera module 680, a power management module 688, a battery 689, a communication module 690, a subscriber identification module 696, and an antenna module 697. According to some embodiments, at least one (e.g., the display device 660 or the camera module 680) among components of the electronic device 601 may be omitted or other components may be added to the electronic device 601. According to some embodiments, some components may be integrated and implemented as in the case of the sensor module 676 (e.g., a fingerprint sensor, an iris sensor, or an illuminance sensor) embedded in the display device 660 (e.g., a display).

The processor 620 may operate, for example, software (e.g., a program 640) to control at least one of other components (e.g., a hardware or software component) of the electronic device 601 connected to the processor 620 and may process and compute a variety of data. The processor 620 may load a command set or data, which is received from other components (e.g., the sensor module 676 or the communication module 690), into a volatile memory 632, may process the loaded command or data, and may store result data into a nonvolatile memory 634. According to an embodiment, the processor 620 may include a main processor 621 (e.g., a central processing unit or an application processor) and an auxiliary processor 623 (e.g., a graphic processing device, an image signal processor, a sensor hub processor, or a communication processor), which operates independently from the main processor 621, additionally or alternatively uses less power than the main processor 621, or is specified to a designated function. In this case, the auxiliary processor 623 may operate separately from the main processor 621 or embedded.

In this case, the auxiliary processor 623 may control, for example, at least some of functions or states associated with at least one component (e.g., the display device 660, the sensor module 676, or the communication module 690) among the components of the electronic device 601 instead of the main processor 621 while the main processor 621 is in an inactive (e.g., sleep) state or together with the main processor 621 while the main processor 621 is in an active (e.g., an application execution) state. According to an embodiment, the auxiliary processor 623 (e.g., the image signal processor or the communication processor) may be implemented as a part of another component (e.g., the camera module 680 or the communication module 690) that is functionally related to the auxiliary processor 623. The memory 630 may store a variety of data used by at least one component (e.g., the processor 620 or the sensor module 676) of the electronic device 601, for example, software (e.g., the program 640) and input data or output data with respect to commands associated with the software. The memory 630 may include the volatile memory 632 or the nonvolatile memory 634.

The program 640 may be stored in the memory 630 as software and may include, for example, an operating system 642, a middleware 644, or an application 646.

The input device 650 may be a device for receiving a command or data, which is used for a component (e.g., the processor 620) of the electronic device 601, from an outside (e.g., a user) of the electronic device 601 and may include, for example, a microphone, a mouse, or a keyboard.

The sound output device 655 may be a device for outputting a sound signal to the outside of the electronic device 601 and may include, for example, a speaker used for general purposes, such as multimedia play or recordings play, and a receiver used only for receiving calls. According to an embodiment, the receiver and the speaker may be either integrally or separately implemented.

The display device 660 may be a device for visually presenting information to the user of the electronic device 601 and may include, for example, a display, a hologram device, or a projector and a control circuit for controlling a corresponding device. According to an embodiment, the display device 660 may include a touch circuitry or a pressure sensor for measuring an intensity of pressure on the touch.

The audio module 670 may convert a sound and an electrical signal in dual directions. According to an embodiment, the audio module 670 may obtain the sound through the input device 650 or may output the sound through an external electronic device (e.g., the electronic device 602 (e.g., a speaker or a headphone)) wired or wirelessly connected to the sound output device 655 or the electronic device 601.

The sensor module 676 may generate an electrical signal or a data value corresponding to an operating state (e.g., power or temperature) inside or an environmental state outside the electronic device 601. The sensor module 676 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 677 may support a designated protocol wired or wirelessly connected to the external electronic device (e.g., the electronic device 602). According to an embodiment, the interface 677 may include, for example, an HDMI (high-definition multimedia interface), a USB (universal serial bus) interface, an SD card interface, or an audio interface.

A connecting terminal 678 may include a connector that physically connects the electronic device 601 to the external electronic device (e.g., the electronic device 602), for example, an HDMI connector, a USB connector, an SD card connector, or an audio connector (e.g., a headphone connector).

The haptic module 679 may convert an electrical signal to a mechanical stimulation (e.g., vibration or movement) or an electrical stimulation perceived by the user through tactile or kinesthetic sensations. The haptic module 679 may include, for example, a motor, a piezoelectric element, or an electric stimulator.

The camera module 680 may shoot a still image or a video image. According to an embodiment, the camera module 680 may include, for example, at least one lens, an image sensor, an image signal processor, or a flash.

The power management module 688 may be a module for managing power supplied to the electronic device 601 and may serve as at least a part of a power management integrated circuit (PMIC).

The battery 689 may be a device for supplying power to at least one component of the electronic device 601 and may include, for example, a non-rechargeable (primary) battery, a rechargeable (secondary) battery, or a fuel cell.

The communication module 690 may establish a wired or wireless communication channel between the electronic device 601 and the external electronic device (e.g., the electronic device 602, the electronic device 604, or the server 608) and support communication execution through the established communication channel. The communication module 690 may include at least one communication processor operating independently from the processor 620 (e.g., the application processor) and supporting the wired communication or the wireless communication. According to an embodiment, the communication module 690 may include a wireless communication module 692 (e.g., a cellular communication module, a short-range wireless communication module, or a GNSS (global navigation satellite system) communication module) or a wired communication module 694 (e.g., an LAN (local area network) communication module or a power line communication module) and may communicate with the external electronic device using a corresponding communication module among them through the first network 698 (e.g., the short-range communication network such as a Bluetooth, a WiFi direct, or an IrDA (infrared data association)) or the second network 699 (e.g., the long-distance wireless communication network such as a cellular network, an internet, or a computer network (e.g., LAN or WAN)). The above-mentioned various communication modules 690 may be implemented into one chip or into separate chips, respectively.

According to an embodiment, the wireless communication module 692 may identify and authenticate the electronic device 601 using user information stored in the subscriber identification module 696 in the communication network.

The antenna module 697 may include one or more antennas to transmit or receive the signal or power to or from an external source. According to an embodiment, the communication module 690 (e.g., the wireless communication module 692) may transmit or receive the signal to or from the external electronic device through the antenna suitable for the communication method.

Some components among the components may be connected to each other through a communication method (e.g., a bus, a GPIO (general purpose input/output), an SPI (serial peripheral interface), or an MIPI (mobile industry processor interface)) used between peripheral devices to exchange signals (e.g., a command or data) with each other.

According to an embodiment, the command or data may be transmitted or received between the electronic device 601 and the external electronic device 604 through the server 608 connected to the second network 699. Each of the electronic devices 602 and 604 may be the same or different types as or from the electronic device 601. According to an embodiment, all or some of the operations performed by the electronic device 601 may be performed by another electronic device or a plurality of external electronic devices. When the electronic device 601 performs some functions or services automatically or by request, the electronic device 601 may request the external electronic device to perform at least some of the functions related to the functions or services, in addition to or instead of performing the functions or services by itself. The external electronic device receiving the request may carry out the requested function or the additional function and transmit the result to the electronic device 601. The electronic device 601 may provide the requested functions or services based on the received result as is or after additionally processing the received result. To this end, for example, a cloud computing, distributed computing, or client-server computing technology may be used.

Figure 7:
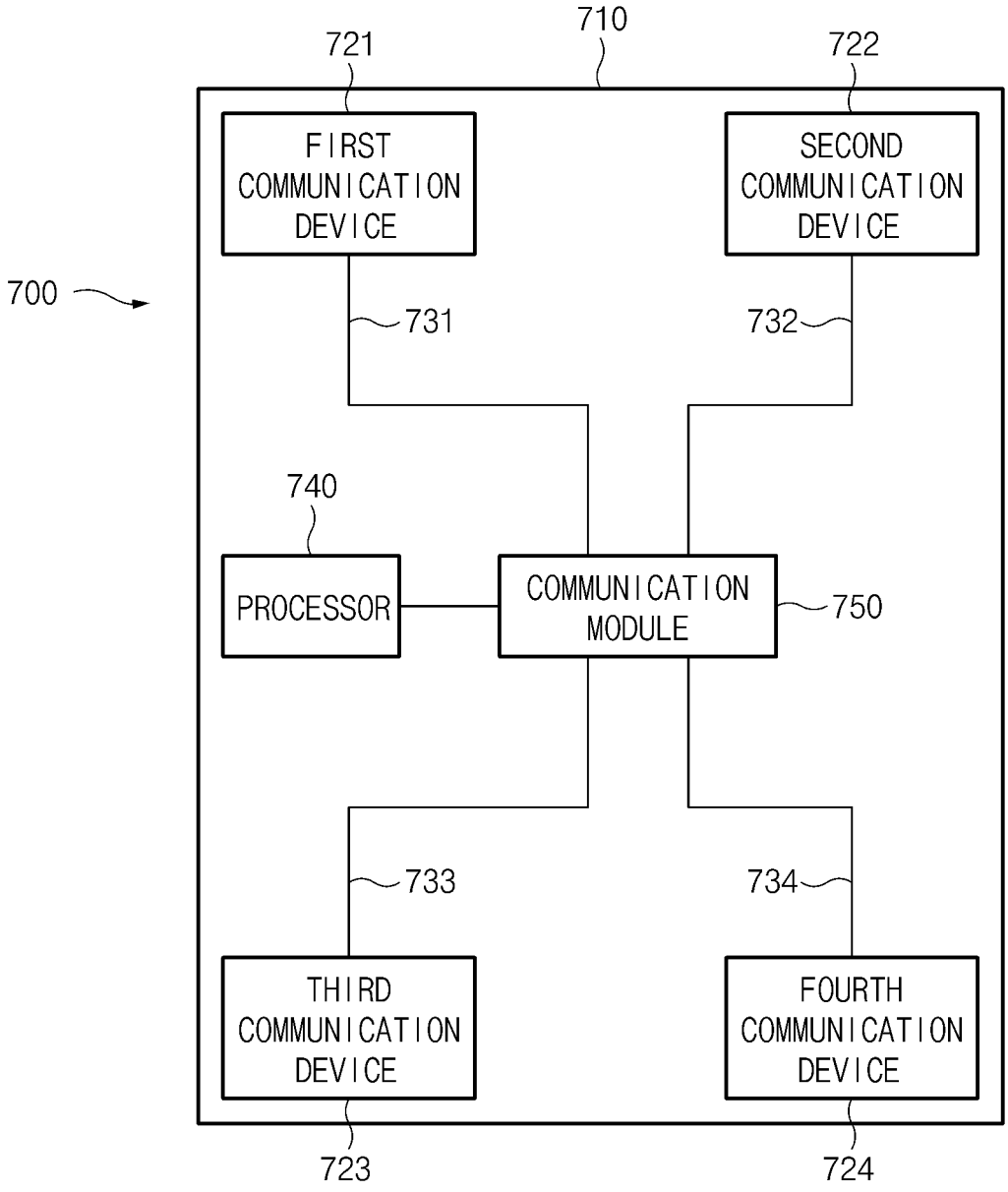
FIG. 7 is a diagram illustrating an example of an electronic device supporting 5 G communication.

FIG. 7 is a view illustrating an example of an electronic device 700 supporting 5 G communication.

Referring to FIG. 7, the electronic device 700 may include a housing 710, a processor 740, a communication module 750 (e.g., the communication module 890 of FIG. 8), a first communication device 721, a second communication device 722, a third communication device 723, a fourth communication device 724, a first conductive line 731, a second conductive line 732, a third conductive line 733, or a fourth conductive line 734.

According to an embodiment, the housing 710 may protect any other components of the electronic device 700. The housing 710 may include, for example, a front plate, a back plate facing away from the front plate, and a side member (or a metal frame) surrounding a space between the front plate and the back plate. The side member may be attached to the back plate or may be integrally formed with the back plate.

According to an embodiment, the electronic device 700 may include at least one communication device. For example, the electronic device 700 may include the first communication device 721, the second communication device 722, the third communication device 723, or the fourth communication device 724.

According to an embodiment, the first communication device 721, the second communication device 722, the third communication device 723, or the fourth communication device 724 may be positioned within the housing 710. According to an embodiment, when viewed from above the front plate of the electronic device 700, the first communication device 721 may be positioned at an upper left end of the electronic device 700, the second communication device 722 may be positioned at an upper right end of the electronic device 700, the third communication device 723 may be positioned at a lower left end of the electronic device 700, and the fourth communication device 724 may be positioned at a lower right end of the electronic device 700.

According to an embodiment, the processor 740 may include one or more of a central processing unit, an application processor, a graphic processing unit (GPU), an image signal processor of a camera, or a baseband processor (or a communication processor (CP)). According to an embodiment, the processor 740 may be implemented with a system on chip (SoC) or a system in package (SiP).

According to an embodiment, the communication module 750 may be electrically connected with at least one communication device by using at least one conductive line. For example, the communication module 750 may be electrically connected with the first communication device 721, the second communication device 722, the third communication device 723, or the fourth communication device 724 by using the first conductive line 731, the second conductive line 732, the third conductive line 733, or the fourth conductive line 734. The communication module 750 may include a baseband processor, an RFIC, or an IFIC. The communication module 750 may include a baseband processor which is independent of the processor 740 (e.g., an application processor (AP)). The first conductive line 731, the second conductive line 732, the third conductive line 733, or the fourth conductive line 734 may include, for example, a coaxial cable or an FPCB.

According to an embodiment, the communication module 750 may include a first baseband processor (BP) (not illustrated) or a second baseband processor (not illustrated). The electronic device 700 may further include one or more interfaces for supporting inter-chip communication between the first BP (or the second BP) and the processor 740. The processor 740 and the first BP or the second BP may transmit/receive data by using the inter-chip interface (e.g., an inter processor communication channel).

According to an embodiment, the first BP or the second BP may provide an interface for performing communication with any other entities. The first BP may support, for example, wireless communication with regard to a first network (not illustrated). The second BP may support, for example, wireless communication with regard to a second network (not illustrated).

According to an embodiment, the first BP or the second BP may form one module with the processor 740. For example, the first BP or the second BP may be integrally formed with the processor 740. For another example, the first BP or the second BP may be positioned within one chip or may be implemented in the form of an independent chip. According to an embodiment, the processor 740 and at least one baseband processor (e.g., the first BP) may be integrally formed within one chip (a SoC), and another baseband processor (e.g., the second BP) may be implemented in the form of an independent chip.

Figure 8:
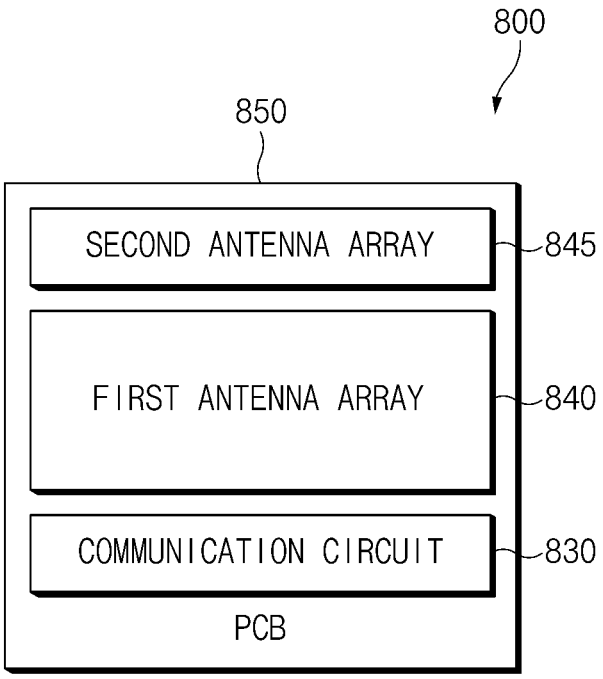
FIG. 8 is a block diagram of a communication device according to an embodiment.

According to an embodiment, the first network (not illustrated) or the second network (not illustrated) may correspond to the network 899 of FIG. 8. According to an embodiment, the first network (not illustrated) and the second network (not illustrated) may include a 4 G network and a 5 G network, respectively. The 4 G network may support, for example, a long term evolution (LTE) protocol defined in the 3GPP. The 5 G network may support, for example, a new radio (NR) protocol defined in the 3GPP.

FIG. 8 is a block diagram illustrating an example of a communication device 800.

Referring to FIG. 8, the communication device 800 may include a communication circuit 830 (e.g., an RFIC), a PCB 850, and at least one antenna array (e.g., a first antenna array 840 or a second antenna array 845).

According to an embodiment, a communication circuit or at least one antenna array may be positioned on or in the PCB 850. For example, the first antenna array 840 or the second antenna array 845 may be positioned on a first surface of the PCB 850, and the RFIC 830 may be positioned on a second surface of the PCB 850. The PCB 850 may include a coaxial cable connector or a board to board (B-to-B) connector for electrical connection with any other PCB (e.g., a PCB on which the communication module 750 of FIG. 7 is positioned) by using a transmission line (e.g., the first conductive line 731 of FIG. 7 or a coaxial cable). The PCB 850 may be connected with the PCB, on which the communication module 750 is positioned, for example, by using a coaxial cable, and the coaxial cable may be used to transmit a receive/transmit IF or RF signal. For another example, a power or any other control signal may be provided through the B-to-B connector.

According to an embodiment, the first antenna array 840 or the second antenna array 845 may include a plurality of antenna elements. The plurality of antenna elements may include a patch antenna or a dipole antenna. For example, an antenna element included in the first antenna array 840 may be a patch antenna for forming a beam toward a back plate of the electronic device 700. For another example, an antenna element included in the second antenna array 845 may be a dipole antenna for forming a beam toward a side member of the electronic device 700.

According to an embodiment, the communication circuit 830 may support a frequency band ranging from 24 GHz to 30 GHz or ranging from 37 GHz to 40 GHz. According to an embodiment, the communication circuit 830 may up-convert or down-convert a frequency. For example, a communication circuit included in the first communication device 721 may up-convert an IF signal received from the communication module 750 through the first conductive line 731. For another example, the communication circuit may down-convert a millimeter wave signal received through the first antenna array 840 or the second antenna array 845 included in the first communication device 721 and may transmit the down-converted signal to the communication module 750.

The electronic device according to various embodiments disclosed in the present disclosure may be various types of devices. The electronic device may include, for example, at least one of a portable communication device (e.g., a smartphone), a computer device, a portable multimedia device, a mobile medical appliance, a camera, a wearable device, or a home appliance. The electronic device according to an embodiment of the present disclosure should not be limited to the above-mentioned devices.

It should be understood that various embodiments of the present disclosure and terms used in the embodiments do not intend to limit technologies disclosed in the present disclosure to the particular forms disclosed herein; rather, the present disclosure should be construed to cover various modifications, equivalents, and/or alternatives of embodiments of the present disclosure. With regard to description of drawings, similar components may be assigned with similar reference numerals. As used herein, singular forms may include plural forms as well unless the context clearly indicates otherwise. In the present disclosure disclosed herein, the expressions "A or B", "at least one of A or/and B", "A, B, or C" or "one or more of A, B, or/and C", and the like used herein may include any and all combinations of one or more of the associated listed items. The expressions "a first", "a second", "the first", or "the second", used in herein, may refer to various components regardless of the order and/or the importance, but do not limit the corresponding components. The above expressions are used merely for the purpose of distinguishing a component from the other components. It should be understood that when a component (e.g., a first component) is referred to as being (operatively or communicatively) "connected," or "coupled," to another component (e.g., a second component), it may be directly connected or coupled directly to the other component or any other component (e.g., a third component) may be interposed between them.

The term "module" used herein may represent, for example, a unit including one or more combinations of hardware, software and firmware. The term "module" may be interchangeably used with the terms "logic", "logical block", "part" and "circuit". The "module" may be a minimum unit of an integrated part or may be a part thereof. The "module" may be a minimum unit for performing one or more functions or a part thereof. For example, the "module" may include an application-specific integrated circuit (ASIC).

Various embodiments of the present disclosure may be implemented by software (e.g., the program 640) including an instruction stored in a machine-readable storage media (e.g., an internal memory 636 or an external memory 638) readable by a machine (e.g., a computer). The machine may be a device that calls the instruction from the machine-readable storage media and operates depending on the called instruction and may include the electronic device (e.g., the electronic device 601). When the instruction is executed by the processor (e.g., the processor 620), the processor may perform a function corresponding to the instruction directly or using other components under the control of the processor. The instruction may include a code made by a compiler or a code executable by an interpreter. The machine-readable storage media may be provided in the form of non-transitory storage media. Here, the term "non-transitory", as used herein, is a limitation of the medium itself (i.e., tangible, not a signal) as opposed to a limitation on data storage persistency.

According to an embodiment, the method according to various embodiments disclosed in the present disclosure may be provided as a part of a computer program product. The computer program product may be traded between a seller and a buyer as a product. The computer program product may be distributed in the form of machine-readable storage medium (e.g., a compact disc read only memory (CD-ROM)) or may be distributed only through an application store (e.g., a Play Store™). In the case of online distribution, at least a portion of the computer program product may be temporarily stored or generated in a storage medium such as a memory of a manufacturer's server, an application store's server, or a relay server.

Each component (e.g., the module or the program) according to various embodiments may include at least one of the above components, and a portion of the above sub-components may be omitted, or additional other sub-components may be further included. Alternatively or additionally, some components (e.g., the module or the program) may be integrated in one component and may perform the same or similar functions performed by each corresponding components prior to the integration. Operations performed by a module, a programming, or other components according to various embodiments of the present disclosure may be executed sequentially, in parallel, repeatedly, or in a heuristic method. Also, at least some operations may be executed in different sequences, omitted, or other operations may be added.

According to the embodiments disclosed in the disclosure, it is possible to simplify the structure of a communication device and a manufacturing process. According to the embodiments disclosed in the disclosure, it is possible to improve the performance of the communication device.

In addition, various effects can be provided which are directly or indirectly understood through the disclosure.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a rear cover;

a cover glass configured to face the rear cover; and a communication device disposed between the rear cover and the cover glass, wherein the communication device includes:

a printed circuit board having a first surface and a second surface configured to face the first surface;

a communication circuit disposed in the printed circuit board or on the first surface; and a plurality of antenna units disposed in the printed circuit board or on the second surface, wherein each of the plurality of antenna units includes:

a structure disposed on the second surface and forming an opening, the structure including a side surface surrounding at least a portion of the opening and a top surface connected to the side surface to cover the opening;

a patch type radiator disposed in the opening, the patch type radiator overlaps the top surface in a top view of the second surface of the printed circuit board; and a feeder configured to connect the patch type radiator and the communication circuit, and wherein the communication circuit feeds power to the feeder and transmits and receives a signal in a specified frequency band via an electrical path formed through the feeder and the patch type radiator, and wherein the plurality of antenna units include a first antenna unit and a second antenna unit arrayed in one direction, and the side surface of the structure included in the first antenna unit and the side surface of the structure included in the second antenna unit are disposed to partially face each other.

2. The electronic device of claim 1, wherein the side surface of the structure includes a first curved surface configured to surround at least the portion of the opening and a second curved surface disposed opposite the first curved surface with respect to the opening.

3. The electronic device of claim 2, wherein a distance between the first curved surface and the second curved surface is greater than a diameter of the patch type radiator.

4. The electronic device of claim 1, wherein the side surface of the structure has a cylindrical shape.

5. The electronic device of claim 1, wherein the structure further includes a bottom surface configured to extend from the side surface of the structure in a direction parallel to the second surface.

6. The electronic device of claim 5, wherein the bottom surface is attached to the second surface with an adhesive material.

7. The electronic device of claim 1, wherein the top surface and the patch type radiator are separated by a specified distance.

8. The electronic device of claim 1, wherein the patch type radiator is disposed in the printed circuit board or on the second surface.

9. The electronic device of claim 1, wherein the printed circuit board includes a plurality of layers, and wherein at least one of the plurality of layers includes a dielectric.

10. The electronic device of claim 1, further comprising a pad disposed in the printed circuit board or on the second surface, wherein the patch type radiator is disposed on the pad.

11. The electronic device of claim 1, wherein the communication device is attached to the rear cover.

12. The electronic device of claim 1, wherein the communication circuit transmits another signal from the patch type radiator toward the top surface.

13. The electronic device of claim 1, further comprising a display disposed between the communication device and the cover glass, and an additional printed circuit board.

14. A communication device comprising:

a printed circuit board having a first surface and a second surface configured to face the first surface;

a plurality of antenna units disposed in the printed circuit board or on the first surface, wherein each of the plurality of antenna units including a patch type radiator disposed in the printed circuit board or on the first surface, a feeder configured to extend from the patch type radiator toward the second surface, and a structure disposed on the first surface and having an opening formed in a region corresponding to the patch type radiator, the structure including a side surface surrounding at least a portion of the opening and a top surface covering the opening; and a communication circuit disposed in the printed circuit board or on the second surface to feed power to the feeder and transceive a signal in a specified frequency band via an electrical path formed through the feeder and the patch type radiator, and wherein the plurality of antenna units include a first antenna unit and a second antenna unit arrayed in one direction, and the side surface of the structure included in the first antenna unit and the side surface of the structure included in the second antenna unit are disposed to partially face each other.

15. The communication device of claim 14, wherein the side surface of the structure includes a first curved surface configured to surround at least the portion of the opening and a second curved surface disposed opposite the first curved surface with respect to the opening.

16. The communication device of claim 15, wherein a distance between the first curved surface and the second curved surface is greater than a diameter of the patch type radiator.

17. The communication device of claim 14, wherein the side surface of the structure has a cylindrical shape.

18. The communication device of claim 14, wherein the structure further includes a bottom surface configured to extend from the side surface of the structure in a direction parallel to the first surface.

19. The communication device of claim 18, wherein the bottom surface is attached to the first surface with an adhesive material.

20. The communication device of claim 14, wherein the top surface and the patch type radiator are separated by a specified distance.

* * * * *